US006372972B1

(12) United States Patent
Meinl

(10) Patent No.: US 6,372,972 B1
(45) Date of Patent: Apr. 16, 2002

(54) PROTECTOR DEVICE FOR THE TENSION LOCK ON A CONGA OR THE LIKE

(75) Inventor: Reinhold Meinl, Neustadt a.d. Aisch (DE)

(73) Assignee: Roland Meinl Musikinstrumente GmbH & Co., Neustadt a. d. Aisch (DE)

( * ) Notice: Subject to any disclaimer, the term of this patent is extended or adjusted under 35 U.S.C. 154(b) by 0 days.

(21) Appl. No.: 09/822,176

(22) Filed: Apr. 2, 2001

(30) Foreign Application Priority Data

Oct. 21, 2000 (DE) ..... 200 18 060 U

(51) Int. Cl.[7] ..... G10D 13/02
(52) U.S. Cl. ..... 84/411 R; 84/413; 84/453
(58) Field of Search ..... 84/411 R, 413, 84/419, 420, 411 A, 453

(56) References Cited

U.S. PATENT DOCUMENTS 3,125,190 A 3/1964 Brennan
4,122,747 A 10/1978 Yamashita
6,018,116 A 1/2000 Simons et al.
6,278,045 B1 * 8/2001 Reyes ..... 84/411 R

FOREIGN PATENT DOCUMENTS

DE 44 43 604 7/1995
GB 913631 12/1962

* cited by examiner

*Primary Examiner*—Shih-Yung Hsieh
(74) *Attorney, Agent, or Firm*—Browdy and Neimark, P.L.L.C.

(57) ABSTRACT

With a view to improving a protector device for the tension lock of a conga or the like so as to obtain cost-effective production and easy attachment and the possibility of operation of the tension nut in the attached condition, the protector device comprises a main body, which is U-shaped in its horizontal cross section and radially open on the inside toward the conga, accepting the tension lug of the conga; a cover; a bottom; a slot in the cover; a slot in the bottom; a cutout in the cover, into which the slot opens and which, in the attached position, encompasses the region of the outer thread of the tension hook; and a cutout in the bottom, into which the slot opens and which, in the attached position, encompasses the top of the tension nut.

3 Claims, 1 Drawing Sheet

PROTECTOR DEVICE FOR THE TENSION LOCK ON A CONGA OR THE LIKE

BACKGROUND OF THE INVENTION

1. Field of the Invention

The present invention relates to a protector device for the tension lock on a conga or the like, i.e., for percussion instruments having a skin that can be tensioned and tuned by means of rods using a multiplicity of tension locks spaced around the instrument's periphery.

2. Background Art

Tension locks of this type are known in different percussion instruments; in congas in particular, due to the convexity of the resonant body, they often lead to damage when two congas collide during transportation or while they are being played.

It is already known to provide protector devices for the tension locks in order to prevent adjacently situated instruments from being scratched; the known protector devices have the shortcoming however, that they are not easy to attach and the instruments cannot be tuned with the protector devices attached.

SUMMARY OF THE INVENTION

Proceeding from the above, the invention has as its object to improve a protector device of the above type in such a way that it can be created cost-effectively and easily attached and that an operation of the tension nut is possible in the attached condition.

This object is solved according to the invention with a main body being U-shaped in its horizontal cross section, radially open on the inside toward the conga and accepting the tension lug of the conga; also a cover; a bottom; a slot in the cover; a slot in the bottom; a cutout in the cover into which the slot opens and which, in the attached position, encompasses the region of the exterior thread of the tension hook; and a cutout in the bottom into which the slot opens and which, when in the attached position, encompasses the top of the tension nut.

A protector device according to the invention can, accordingly, be snapped onto the tension lock in a radially inward direction, widening the slots in the process, and then reliably protects a tension lock with a protector device from scratching an adjacently situated instrument. Furthermore, injuries during carrying and playing are also prevented. Since the bottom of the protector device encloses only the upper side of the tuning rod, retightening and tuning is possible without problem even with the protector device attached.

The protector device is advantageously molded in one piece from plastic and can thus be manufactured cost-effectively. A conically outward directed base on the underside makes the protector device appear decorative and ensures additional protection, particularly for instruments where the tensioning screws are located at an angle.

The invention will be described in greater detail below based on a preferred embodiment in combination with the drawing.

DESCRIPTION OF THE PREFERRED EMBODIMENT

Figure 1:
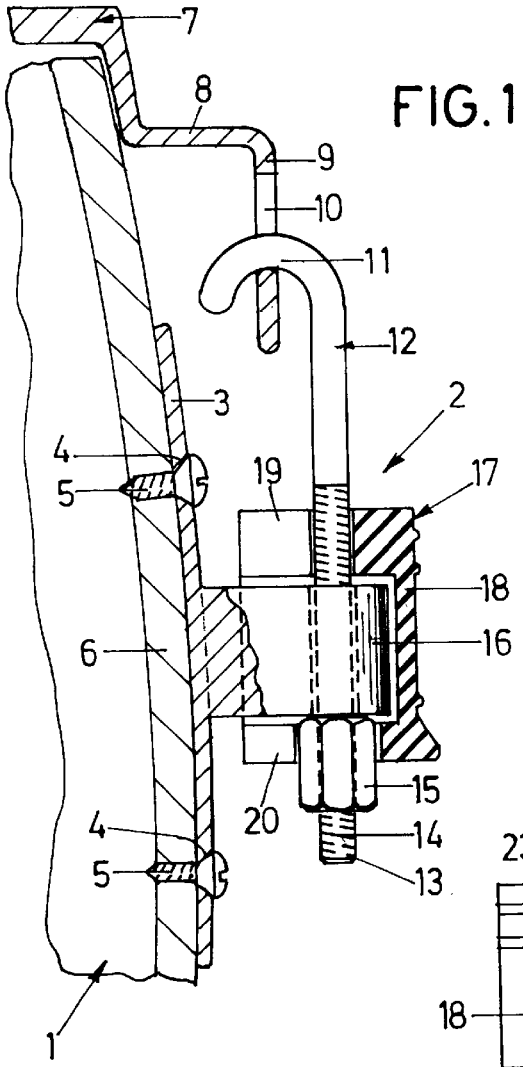
FIG. 1 shows a vertical section through the tension lock region of a conga.
Figure 2:
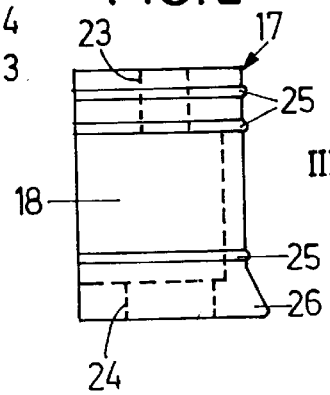
FIG. 2 shows a side view of an inventive protector device.
Figure 3:
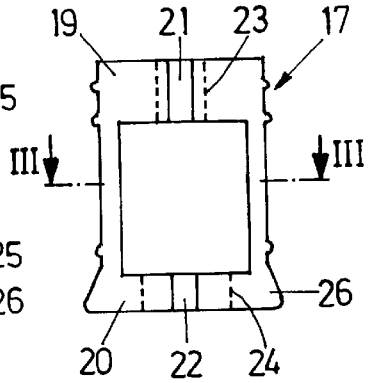
FIG. 3 shows a view of the protector device from inside.
Figure 4:
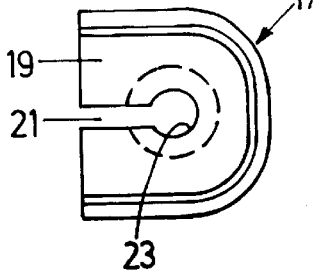
FIG. 4 shows a view of the protector device from above.
Figure 5:
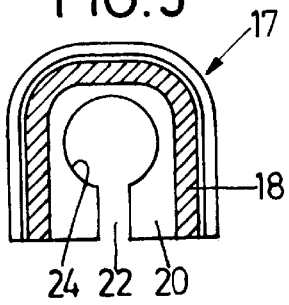
FIG. 5 shows a section through the protector device along the line III—III in FIG. 3.

In FIG. 1 a section of a conga 1 is depicted in the region of the tension lock 2. The tension lock comprises a base plate 3 with bores 4 through which fastening screws 5 are screwed into the wooden wall 6 of the conga 1.

At the top of the conga 1 a tension loop 7 is affixed for the skin, which is not shown in the drawing, to which hooks 8 are fastened that have projections 9 that are crimped in an L-shape and have cutouts 10 into which the end 11 of a tension hook 12 engages, said end being formed like the handle of a walking cane. The end 13 opposite the end 11 of the tension hook 12 is provided with an exterior thread 14 onto which a tension nut 15 is screwed.

The tension hook 12 extends, with the region of its thread 14, through a tension lug 16 that is connected to the base plate 3 of the tension lock 2.

Tightening the tension nut 15 causes the tension hook 12 to be pulled downward so that tension is exerted onto the tension loop 8 and the same is tightened more firmly. By moving the tension nut 15 in the other direction, i.e., by loosening the tension nut 15, the tension onto the tension loop 7, and thus onto the skin, is reduced.

This tension lock 2, especially its tension lug 16, protrudes outward, as is apparent from FIG. 1, beyond the wall 6 of the conga 1. This creates the danger of damage to other musical instruments during transportation or playing, particularly for other congas.

To provide a remedy for this situation, an inventive protector device 17 made of plastic is provided, which is shown in FIG. 2 through 5. It comprises a main body 18, which is approximately U-shaped in its horizontal cross-section (see FIG. 5) and has a cover 19 and a bottom 20 (see FIG. 3 in particular).

The cover 19 has a vertical slot 21 and the bottom 20 has a vertical slot 22, with the upper slot 21 opening into an approximately circular cutout 23 and the lower slot 22 opening into an approximately circular cutout 24 that is larger relative to the cutout 23.

The slots 21, 22 and cutouts 23, 24 are dimensioned such that the protector device 17 can be pushed radially inward from outside, while elastically widening the slots 21, 22, into the position shown in FIG. 1, on the tension lock 2 over the tension lug 16, so that the cover 19 covers the tension lug 16 from the top and the bottom 20 covers the tension lug from below, with the upper cutout 23 encompassing the region of the thread 14, and the lower cutout 24 encompassing the upper region of the tension nut 15. The lower region of the tension nut 15 projects beyond the underside of the bottom 20, so that a tightening of the tension lock 2 via the tension nut 15 is possible even when the protector device 17 is attached, without having to remove the protector device 17.

The main body 18 has peripheral beads 25 and a base 26 that is conically directed outward.

What is claimed is:

1. A protector device for a tension lock (2) of a drum, comprising a main body (18) being U-shaped in its horizontal cross section and radially open on the inside toward the drum (1), accepting a tension lug (16) of the drum (1);

a cover (19);

a bottom (20);

a first slot (21) in the cover (19);

a second slot (22) in the bottom (20);

a cutout (23) in the cover (19), into which the first slot (21) opens and which, in the attached position, encompasses the region of an outer thread (14) of a tension hook (12); and a cutout (24) in the bottom (20), into which the second slot (22) opens and which, in the attached position, encompasses the top of a tension nut (15).

2. A protector device as defined in claim 1, wherein it is molded in one piece from plastic.

3. A protector device as defined in claim 1, wherein it has a base (26) that is conically directed outward.

* * * * *